United States Patent [19]

Considine

[11] Patent Number: 4,842,669

[45] Date of Patent: Jun. 27, 1989

[54] METHOD OF MANUFACTURE AND ASSEMBLY SYSTEM FOR A STRUCTURAL WALL PANEL

[75] Inventor: Richard Considine, Chestertown, N.Y.

[73] Assignee: The Original Lincoln Logs Ltd., Chestertown, N.Y.

[21] Appl. No.: 90,925

[22] Filed: Aug. 31, 1987

Related U.S. Application Data

[63] Continuation-in-part of Ser. No. 76,751, Jul. 23, 1987.

[51] Int. Cl.[4] ..... B32B 31/04; B32B 31/10; B32B 31/12; B32B 31/20

[52] U.S. Cl. ..... 156/288; 52/741; 52/745; 156/556; 156/557; 156/563

[58] Field of Search ..... 156/288, 563, 556, 557, 156/563, 71, 109, 538, 566, 580; 227/14, 152; 52/741, 746, 749, 745

[56] References Cited

U.S. PATENT DOCUMENTS

| | | | |
|---|---|---|---|
| 2,610,938 | 9/1952 | Pasquier | 156/288 |
| 2,730,772 | 1/1956 | Jones | 20/4 |
| 3,149,437 | 9/1958 | Wheeler-Nicholson | 50/373 |
| 3,413,765 | 12/1968 | Williams et al. | 52/99 |
| 3,449,879 | 6/1969 | Bloom | 52/309 |
| 3,665,662 | 5/1972 | Timbrook et al. | 52/92 |
| 3,686,815 | 8/1972 | Von Bose | 52/743 |
| 3,688,965 | 9/1972 | Kellner | 227/100 |
| 3,716,954 | 2/1973 | Kelbish | 52/79 |
| 3,730,816 | 5/1973 | Crawford | 156/563 |
| 3,775,982 | 9/1973 | Schmidt | 52/295 |
| 3,777,430 | 12/1973 | Tischuk | 52/309 |
| 3,785,508 | 1/1974 | Hayden | 156/563 |
| 3,835,601 | 9/1974 | Kelbish | 52/79 |
| 4,071,984 | 2/1978 | Larrow | 72/79.1 |
| 4,174,004 | 4/1979 | Day et al. | 52/309.9 |
| 4,177,101 | 12/1979 | Evans | 156/563 |
| 4,241,555 | 12/1980 | Dickens et al. | 52/454 |
| 4,269,006 | 5/1981 | Larrow | 52/79.1 |
| 4,284,447 | 8/1981 | Dickens et al. | 156/78 |
| 4,316,758 | 2/1982 | Suzuki et al. | 156/563 |
| 4,330,921 | 5/1982 | White | 227/152 |
| 4,349,995 | 9/1982 | Dowler et al. | 52/241 |
| 4,409,768 | 10/1983 | Boden | 52/309.4 |

OTHER PUBLICATIONS

"Thermo-Home Zero Energy Wall Panels" brochure, 1982.

*Primary Examiner*—Merrell C. Cashion, Jr.
*Attorney, Agent, or Firm*—Fleit, Jacobson, Cohn & Price

[57] ABSTRACT

A structural wall panel is manufactured by feeding a wafer board panel in a predetermined direction, applying an adhesive to the wafer board panel as it is being fed, locating the wafer board panel on top of a plurality of wall section components, and pressing the wafer board panel onto the wall section components for a predetermined period of time to secure the wafer board panel to the wall section components.

19 Claims, 6 Drawing Sheets

36
234
196
196
230
238
40
236
240
38
36
230
196
232
230

METHOD OF MANUFACTURE AND ASSEMBLY SYSTEM FOR A STRUCTURAL WALL PANEL

This application is a continuation-in-part of application Ser. No. 076,751, filed July 23, 1987, the disclosure of which is expressly incorporated herein by reference.

BACKGROUND OF THE INVENTION

In recent years, building construction techniques have experienced a rapid transition from traditional "stick" building to less labor-intensive methods. Among these newer developments, "panelization" has emerged as one of the more promising building construction methods. This success is due primarily to two attributes of panelized building systems: (1) opportunity for extensive customization and (2) substantially reduced construction time, as evidenced by erection of a weather-tight shell in a week or less. Residential and commercial customers alike continue to find this combination extremely desirable.

SUMMARY OF THE INVENTION

The structural wall panel manufactured according to the invention includes a rigid insulating material, such as expanded polystyrene (EPS), preferably of 1-lb. density, to which studs and an exterior wafer board panel are bonded. Each pre-engineered structural wall panel includes at least one 2"×6" stud and at least one $5\frac{1}{2}$" thick section of expanded polystyrene (EPS). The stud(s) and EPS section(s) are laminated and adhered to exterior sheeting ($\frac{5}{8}$" wafer board) and pressed to produce a structural wall panel section which is substantially stronger than the wall of a traditional wood-frame house. A series of structural wall panels are assembled on a flat concrete slab foundation to form a precision-engineered house which is approximately 50–60 percent more energy efficient than conventional stick-built construction.

It is the object of the present invention to form a structural wall panel section including a wafer board panel with two opposite lateral edges, a top edge, and a bottom edge, a stud secured to the wafer board panel at one lateral edge and projecting beyond the one lateral edge, and a core secured to the wafer board panel and being recessed from the other lateral edge of the wafer board panel, the stud and core being recessed from the top and bottom edges of the wafer board panel.

It is another object of the present invention to provide a process for manufacturing prefabricated wall panel sections by feeding a wafer board panel in a predetermined direction, applying an adhesive to the wafer board panel as it is being fed, locating the wafer board panel on top of a plurality of wall section components, and pressing the wafer board panel onto the wall section components for a predetermined period of time to secure the wafer board panel to the wall section components.

These and other objects of the invention, as well as many of the intended advantages thereof, will become more readily apparent when reference is made to the following description, taken in conjunction with the accompanying drawings.

DETAILED DESCRIPTION OF THE DRAWINGS

Figure 1:
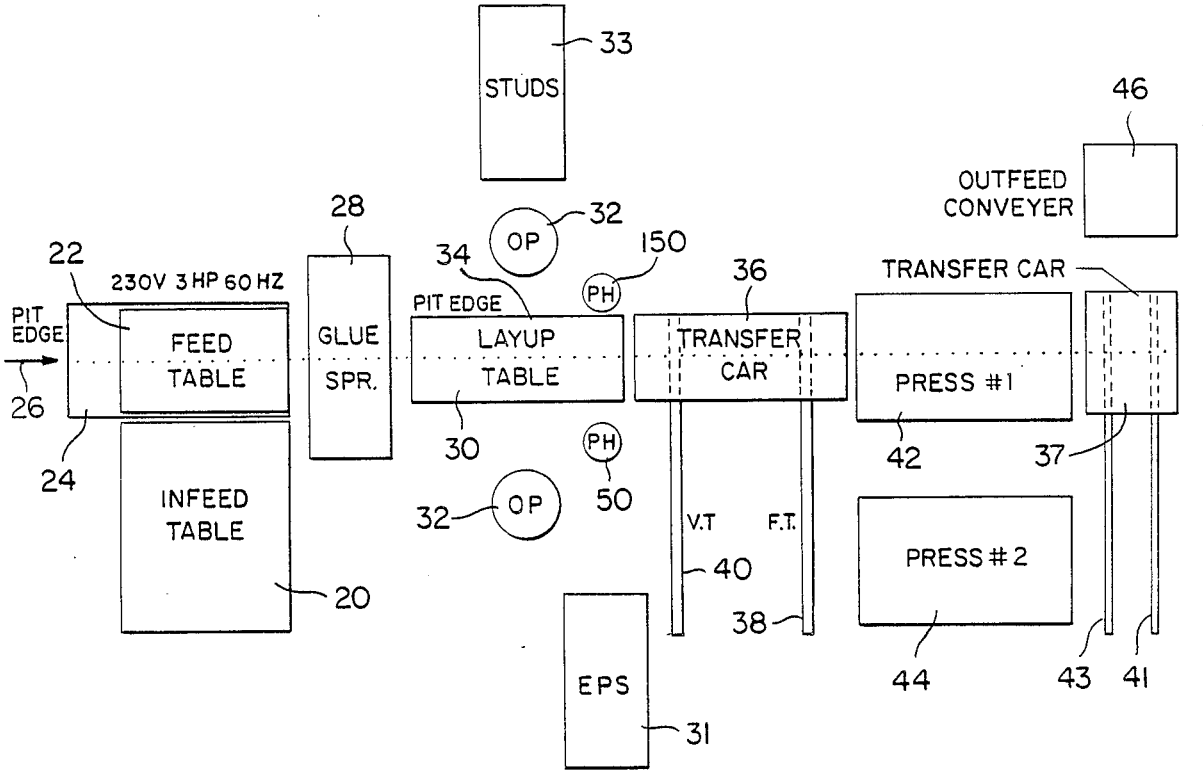
FIG. 1 is a schematic diagram illustrating a system for assembling wall panel sections.

In describing a preferred embodiment of the invention illustrated in the drawings, specific terminology will be resorted to for the sake of clarity; however, the invention is not intended to be limited to the specific terms so selected, and it is to be understood that each specific term includes all technical equivalents which operate in a similar manner to accomplish a similar purpose.

Examples of some of the different structural wall panels which are constructed according to the method of the present invention are shown in FIGS. 9A, 9C, 9D, and 9F through 9J. In these Figures, the different structural wall panels include studs 300, jack studs 310, EPS sections 320, headers 330, and wafer board panels 340. These structural wall panels are further described in U.S. patent application Ser. No. 076,751, filed July 23, 1987, which is incorporated by reference.

With reference to the drawings in general, and to FIG. 1 in particular, an assembly system embodying the teachings of the subject invention is shown. In the manufacture of wall panels, a stack of 50 wafer board panels are placed on infeed conveyor 20 by a fork lift. The infeed conveyor includes three sets of parallel roller ramps. The roller ramps are elevated above the floor so that a space is provided between each adjacent roller ramp for a forklift to set the stack of wafer board panels on the roller ramps.

Feed table 22 is located in a feed table pit 24. Feed table 22 is adjustable in height by a hydraulic scissor arrangement and includes three roller ramps, which are aligned with the three roller ramps of the infeed conveyor 20.

After the top of the feed table is lowered to the same height as the infeed conveyor, a stack of wafer board panels located on the infeed conveyor are manually pushed onto the feed table. The feed table is then raised until the top panel of the stack of wafer board panels is positioned at an infeed height.

A hydraulically controlled scraper is actuated to push off the top panel of the stack and move the top panel in a feed direction, as shown by arrow 26. After the first panel is fed by the scraper, a photocell detects the absence of a panel at the infeed height and causes the feed table to rise to the infeed height so that a second panel is at the same infeed height. This sequence is repeated until the final panel has been advanced.

After the final panel has been advanced, a photocell detects that the feed table is empty. The feed table is then lowered to a stack receiving position. The feed table is then ready for a new stack of panels to be pushed onto the feed table from the infeed conveyor.

The scraper causes each of the wafer board panels to pass through the glue spreader 28, such as is available from Black Brothers Manufacturing Company. The glue spreader includes two rollers. Adhesive is preferably applied only by the bottom roller to the bottom of the panel. The coating roller is run at a feed rate which approximates the speed at which panels are pushed off the feed table into the glue spreader.

The panels received from the feed table are passed to the lay-up table 30 through glue spreader 28, with a continuous coat of adhesive applied to at least one face, preferably the bottom face, ready to be attached to the other components of the wall panel assembly. Before the assembly line operators 32 initiate the feed process of a panel to the lay-up table, the other wall panel subcomponents are assembled on the lay-up table.

The top surface of the lay-up table includes a series of rollers to facilitate transfer of completed wall panels. The lay-up table is vertically adjustable in height by a hydraulic scissor arrangement.

The two operators 32, one positioned on each side of the lay-up table, position on top of the lay-up table, the required number of EPS sections from an EPS stockpile 31 and the required number of studs from stud stockpile 33. The operators then catch a wafer board panel as it is fed through the glue spreader 28. The operators position the wafer board panel on top of one or more studs and one or more sections of expanded polystyrene located on the lay-up table. The operators then nail the wafer board panels to the studs with a retractable, overhead pneumatic air nailing gun.

After the panel has been assembled, the lay-up table is lowered approximately 6 inches to position the top surface of the assembled panel at a working height to facilitate positioning of another wafer board panel onto assembled components of another wall panel. Air operated guides for positioning the wall components and the wafer board panel remain at a fixed height and do not move with the lay-up table.

The process is then repeated for the assembly of wall panels on the lay-up table until a maximum height stack of wall panels, preferably 10 panels, has been completed. A maximum height is achieved by the lay-up table not being able to lower any further within pit 34 to accommodate another panel. The lay-up table is then raised, if necessary, to position the lowermost panel level with transfer car 36, which rides on flat track 38 and vertical track 40 at a distance, preferably 16 inches, above floor level.

The stack of panels are then manually pushed from the lay-up table to the transfer car for movement of the wall panels to one of two presses 42 and 44. The transfer car includes rollers for the transfer of wall panels onto and off of the transfer car 36. The completed stack of wall panels are manually pushed from the transfer car 36 into empty press 42 or 44. The presses include two platens, which are spaced sufficiently apart to receive the stack of panels. The stack is centered in the press before the platens begin pressing towards each other. The top platen is lowered until engaging the stack of panels, and a predetermined pressure is applied. Pressing continues for a period of approximately 30 minutes.

After the pressing cycle is completed, the platens are released. The stack of finished panels is picked up from a side of the press opposite from the transfer car 36 for movement to an outfeed conveyor 46 by another transfer car 37. Transfer car 37 is of similar construction to transfer car 36. Transfer car 37 rides on flat track 41 and vertical track 43.

While press 42 is pressing a stack of panels, another stack of panels is being formed on the lay-up table, which will be transferred to press 44 for final curing of the adhesive. The production rate of panels at the lay-up table is of sufficient duration that one press is always available for receipt of a finished stack of panels.

Figure 2:
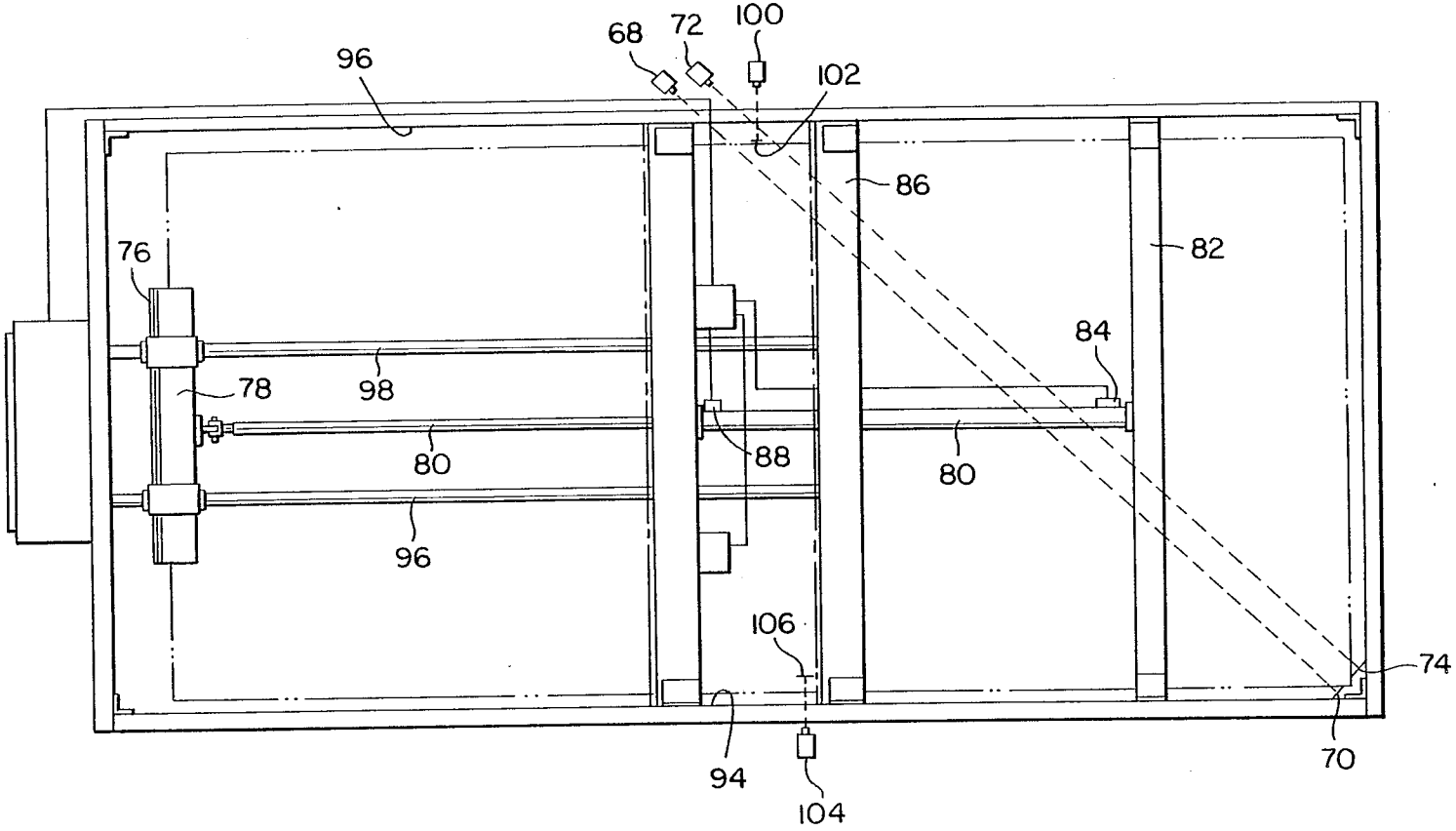
FIG. 2 is a plan view of a feed table.
Figure 6:
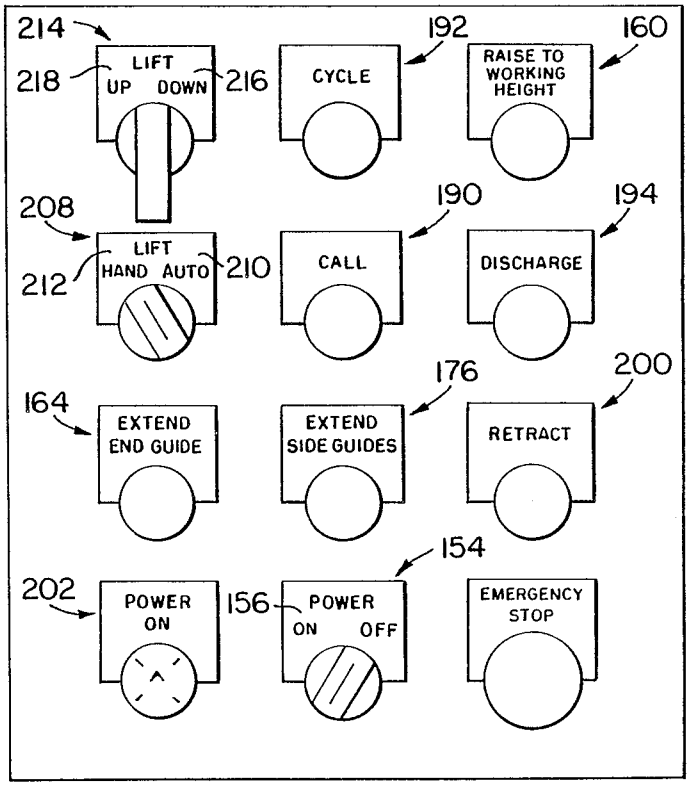
FIG. 6 is an illustration of a console for a lay-up station.
Figure 3:
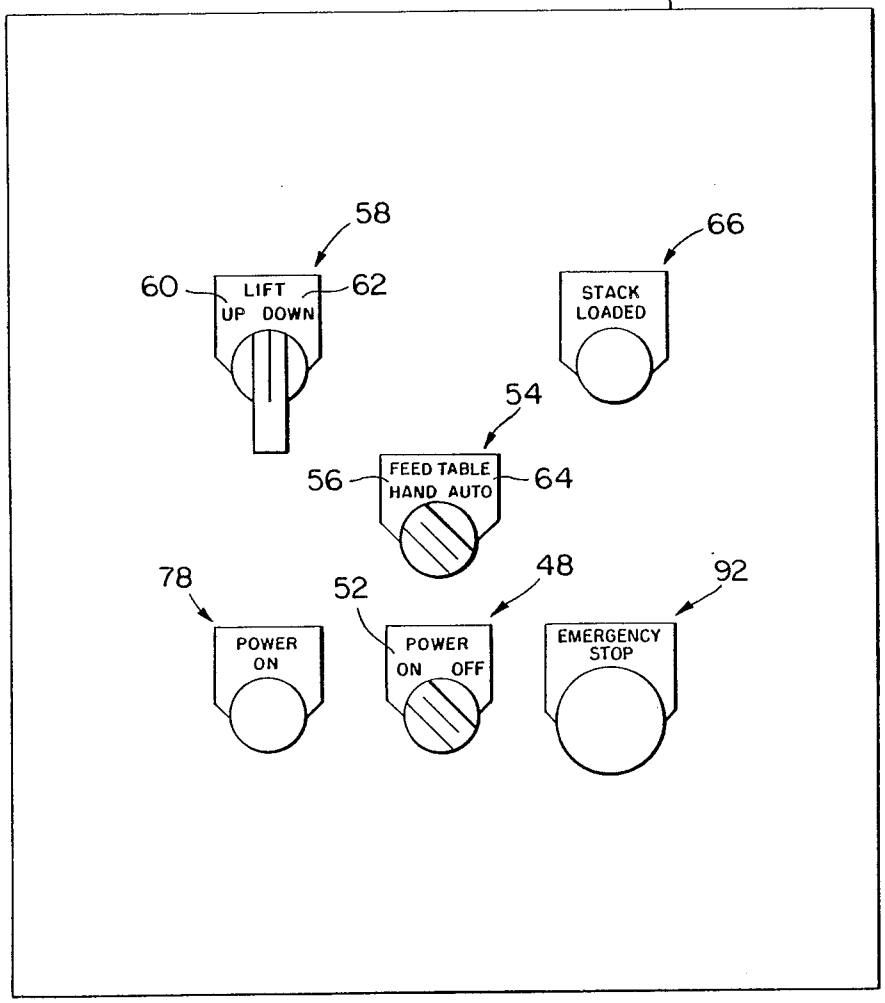
FIG. 3 is an illustration of a control panel for a feed table.
Figure 4:
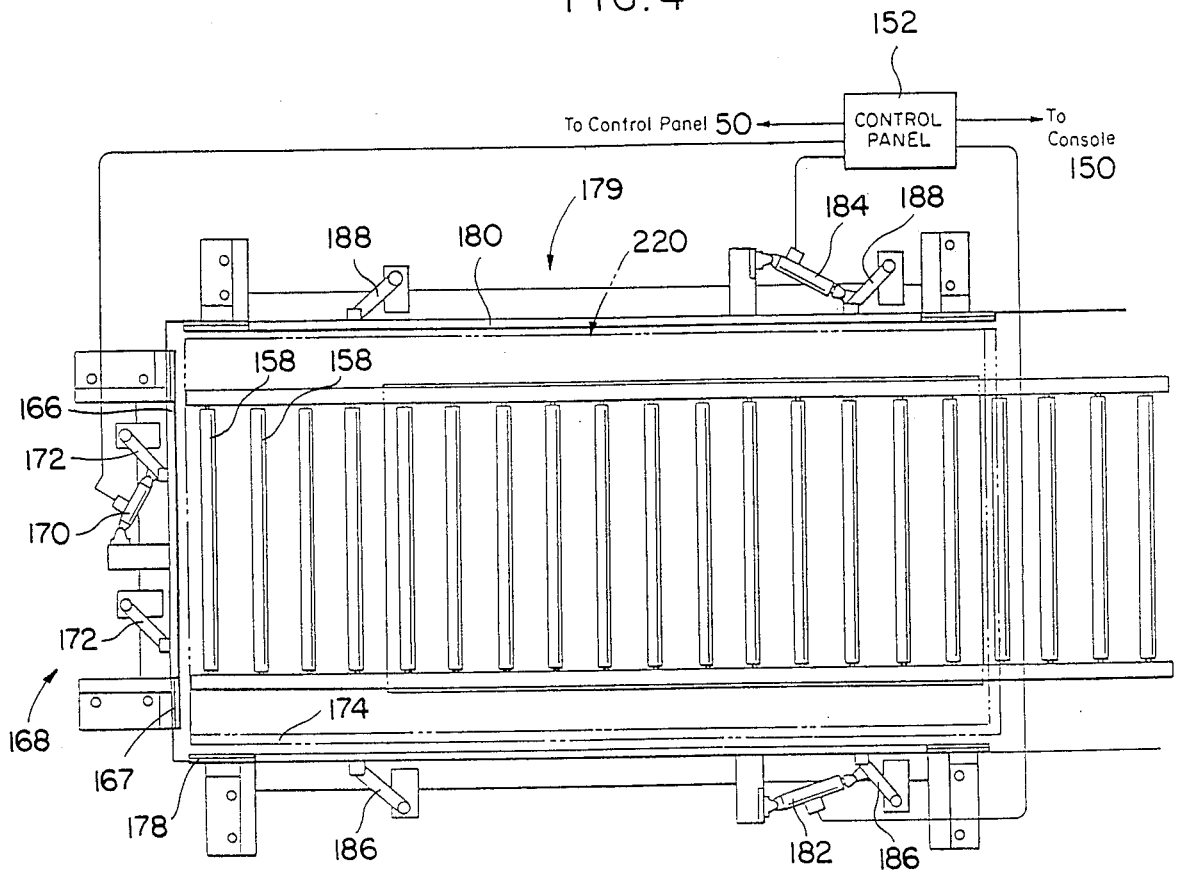
FIG. 4 is a plan view of a lay-up station.

The details of the feed table operation will be described with reference to FIGS. 2 and 3. When an operator loads a stack of panels on infeed conveyor 20, power selector switch 48 from control panel 50 is switched to the "ON" position 52. Feed table 22 should be in a receiving position for a stack of panels. If feed table 22 is not in position for receiving a stack of panels, feed table selector switch 54 is switched to the "HAND" position 56; and the lift selector switch 58 is switched to an "UP" position 60 or a "DOWN" position 62, as appropriate, until the conveyor on the feed table is aligned at a height to receive a stack of panels from infeed conveyor 20. The feed table selector switch 54 is then turned to the "AUTO" position 64, and the stack of panels is manually pushed onto feed table 22.

Operator 32 then actuates the stack-loaded push-button 66. If the top of the stack of panels blocks a beam of light directed between photocell 68 and mirror 70 and a beam of light directed between photocell 72 and mirror 74, the feed table is in too high a position. The feed table is lowered by actuation of lift switch 58 so that only the light beam from photocell 72 is interrupted. Photocell 72 is positioned below, in a heightwise direction, photocell 68. If neither light beam from photocells 68 or 72 is blocked by the stack of panels, the table will be raised by actuation of lift switch 58 until the stack of panels blocks only the light beam from photocell 72.

An interlock (not shown) starts glue spreader 28 when the light beam from photocell 72 is blocked and actuates puller plate 76, which extends vertically downward from crossbar 78. Crossbar 78 is horizontally movable within guide tracks 94 and 96. A piston cylinder assembly 80, mounted at one end on stationary crossbar 82, includes limit switch 84. Crossbar 86, moving with crossbar 78 in guide tracks 94 and 96, upon actuation of the puller plate 76, engages limit switch 84 to indicate completion of its forward movement. Puller plate 76 then reverses its direction of movement to return to its initial extended position and thereby actuates limit switch 88 by crossbar 90, shown in a position past limit switch 88. Crossbars 86 and 90 ride in guide tracks 94 and 96. Crossbar 78, crossbar 86, and crossbar 90 are interconnected by guide rods 98.

Figure 5:
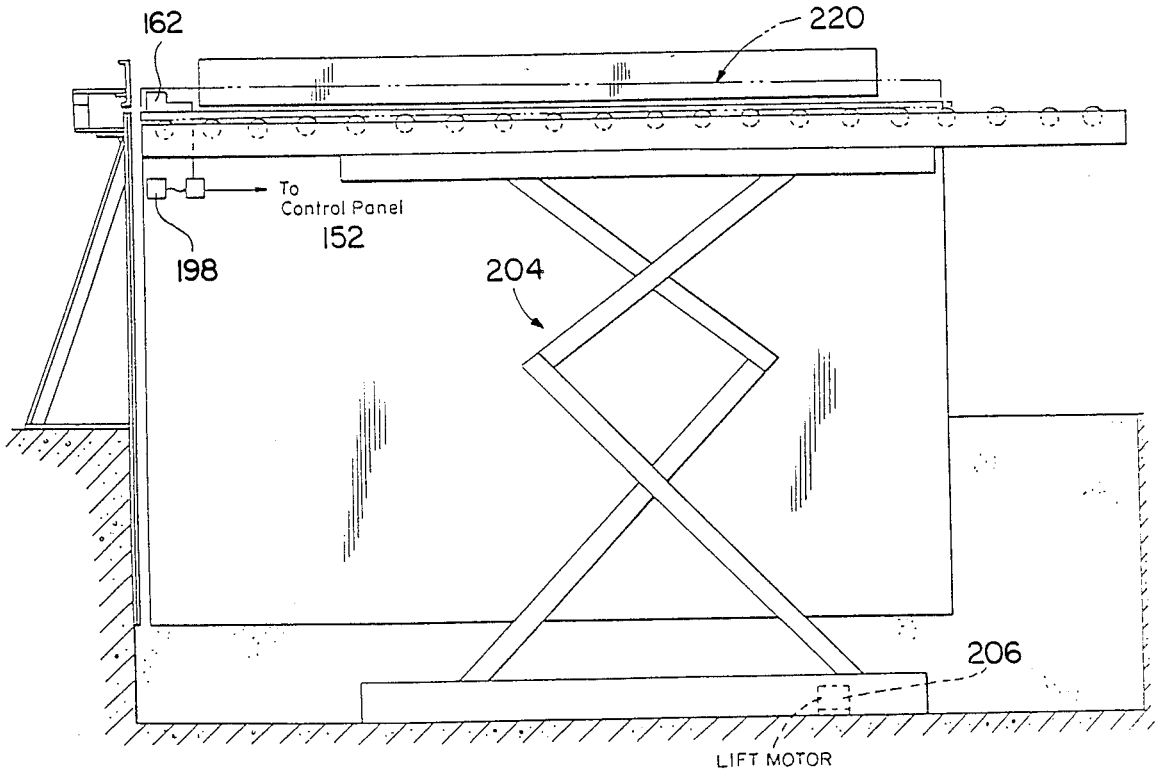
FIG. 5 is a elevational view of the lay-up station shown in FIG. 4.

When limit switch 88 is contacted, the feed table raises the stack of panels by a hydraulic scissor assembly, similar to that shown for the lay-up table in FIG. 5, until the top panel blocks the light beam from photocell 72. This indicates that the feed table is ready for another cycle of advancing a panel. Emergency stop button 92 is provided to halt all activity of the feed table in case of an emergency.

Removal of a panel from the stack of panels on the feed table continues until there is only one panel remaining on the feed table. When the last panel has been fed into the glue spreader and the piston cylinder 80 has returned to its extended position and limit switch 88 has been activated, the feed table will begin to rise to again attempt to block the light beam from photocell 72. However, before the light beam from photocell 72 can be blocked by the feed table 22, a light beam between photocell 100 and mirror 102, which has previously been blocked by the feed table and the stack of panels, will be re-established by the raising of the bottom of the feed table. This indicates that there are no more panels on the feed table.

As soon as the light beam is allowed to extend between photocell 100 and mirror 102, the feed table will reverse direction and will lower until the light beam extending between photocell 104 and mirror 106 is blocked. This position represents the stack-receiving position of the feed table. The feed table will then be ready for receipt of a new stack of panels to be pushed onto the table. Photocell and mirror 100, 102 are located near the top of pit 24 below photocells 68 and 72, whereas photocell 104 and 106 are located near the bottom of the pit.

The controls for the lay-up table include a console 150 and a control panel 152. To begin the operation of the lay-up table, the operator 32 turns on the power selector switch 154 to the "ON" position 156. Initially, there is nothing on the lay-up table. An operator places a workboard on the rollers 158 of the lay-up table to form a bottom support for a stack of wall panel sections to be assembled above the workboard. The operator then actuates the raise-to-working-height button 160, which causes the lay-up table to rise until either the top surface of the rollers 158 of the lay-up table or the workboard interrupt a beam of light from photocell 162. A signal is then sent by photocell 162 to control panel 152. This causes the lay-up table to stop in a position which facilitates the lay-up of the first panel wall components.

The operator then actuates extend end guide button 164, which causes a vertical guide plate 166 at short end 168 of the lay-up table to move from a position spaced from the short end of the lay-up table to a position immediately adjacent to the lay-up table rollers 158. An air-operated piston cylinder 170 causes arms 172, which are mounted at one end on plate 166 and at the other end on a frame spaced from the lay-up table, to move guide plate 166 towards and away from the lay-up table.

Once the guide plate 166 is positioned against the lay-up table, the operator then places a 2"×6" stud against long side fixed position guide 174 located at long side 173 of the lay-up table. A steel spacer 167 having a $1\frac{1}{4}$" width is formed integrally with the short side air-operated vertical guide plate 166, which has been moved to a position adjacent the lay-up table. The stud positioned at the long side 173 is a spacing stud to recess the wall components away from a side edge of a wafer board panel. The steel spacer 167 spaces the wall components away from a top edge of a wafer board panel.

Following this, the operator places a section of expanded polystyrene material into the corner formed by the steel spacer and the spacing stud aligned against the fixed position guide 174. Depending on the construction of the prefabricated panel to be made, it is possible that another stud or jack stud and then another section of EPS material are laid down on the lay-up table in progression, moving away from the fixed position guide 174 but in contact with the previously laid down component, while maintaining contact with the steel spacer or header placed in contact with the steel spacer 167. The last component to be placed on the lay-up table is a stud which will ultimately project from a lateral edge of the wafer board panel at long side 179 upon completion of a structural wall panel.

Extend side guides button 176 is then engaged to move long side vertical guide plates 178 and 180 which is positioned at long side 179 of the lay-up table, towards the center of the lay-up table. Long side vertical guide plates 178 and 180 are operated similarly to short side guide plates 166 by air-operated piston cylinders 182 and 184, respectively, which also include arms 186 and 188, respectively, and are connected, as is air-operated piston cylinder 170, to control panel 152, which is connected to console 150 and control panel 50 for the feed table.

Long side guide plate 180 contacts the components placed on the lay-up table and compresses the components against the fixed long side guide 174 to facilitate the final step of nailing the plywood onto the studs. The long side guide plate 178 extends above the fixed long side guide plate 174 and above the 2"×6" stud contacting the fixed long side guide 174 to act as a guide for the proper positioning of the wafer board panel above the components laid up on the lay-up table. It is intended that the component tolerances (EPS, studs) plus the design of the lay-up table with specific attention to the guide plates and spacer bars and their geometric tolerances are such that the manufactured wall panel, when complete, has consistent, recessed edges on all four sides, except for the stud which projects from one lateral edge of the panel to allow a pre-engineered fit with mating structure, such as sill plate, headers, and other wall panels.

The operator then pushes call button 190 to cause the feed table, when the feed table is in automatic mode of operation, to strip a panel of the stack of panels located on the feed table and feed the panel through the glue spreader. The operators catch the panel as it is fed through the glue spreader and position it against the guide 178 on the long side to provide a $\frac{3}{4}$-inch offset for the panel relative to the components on the long side 173 of the panel. An offset is also provided on the short side of the lay-up table by the panel contacting the vertical guide plate 166 and positioned above the steel spacer 167 to facilitate a $1\frac{1}{4}$-inch overlap of the panel on the short side 168. The operator then nails the plywood to the studs.

After a panel 220 has thus been completed, the operator actuates cycle button 192. This causes all the air operated guides to retract and the lift table to lower by scissor assembly 204, driven by motor 206, until the light beam from photocell 162 is unobstructed. The cycle is then repeated by repeating the sequence of first pushing the extend end guide button 164.

When a maximum height of panels has been completed, which is indicated by the lay-up table being unable to lower far enough to accommodate another panel, the operator pushes the discharge button 194. Actuation of the discharge button causes the lay-up table to raise up to a position where it is level with the conveyor rollers 196 on the transfer car 36. This height is approximately 16 inches above floor level. The light beam extending from photocell 198 is re-established by the lay-up table being raised to its original position, level with the conveyor rollers 198 of the transfer car. The operator then pushes the completed stack of panels off the lay-up table conveyor onto the transfer car for removal to one of the presses.

A safeguard is included to prevent the table from rising if the air-operated guides have not been retracted when the operator pushes the cycle button. To retract the air-operated guides without pressing the cycle button, retract button 200 is actuated.

To initiate operation of the system, power on button 202 is engaged, with the power switch 154 being in the "ON" position 156. Lifting of the lay-up table by hydraulic scissors 204, as driven by lift motor 206, is actuated by engaging lift button 208, either in the automatic position 210 or the manual, hand-operated position 212. In the hand-operated position, lift switch 214 is used to raise or lower the lay-up table by positioning the switch in "DOWN" position 216 or "UP" position 218.

Figures 7, 8:
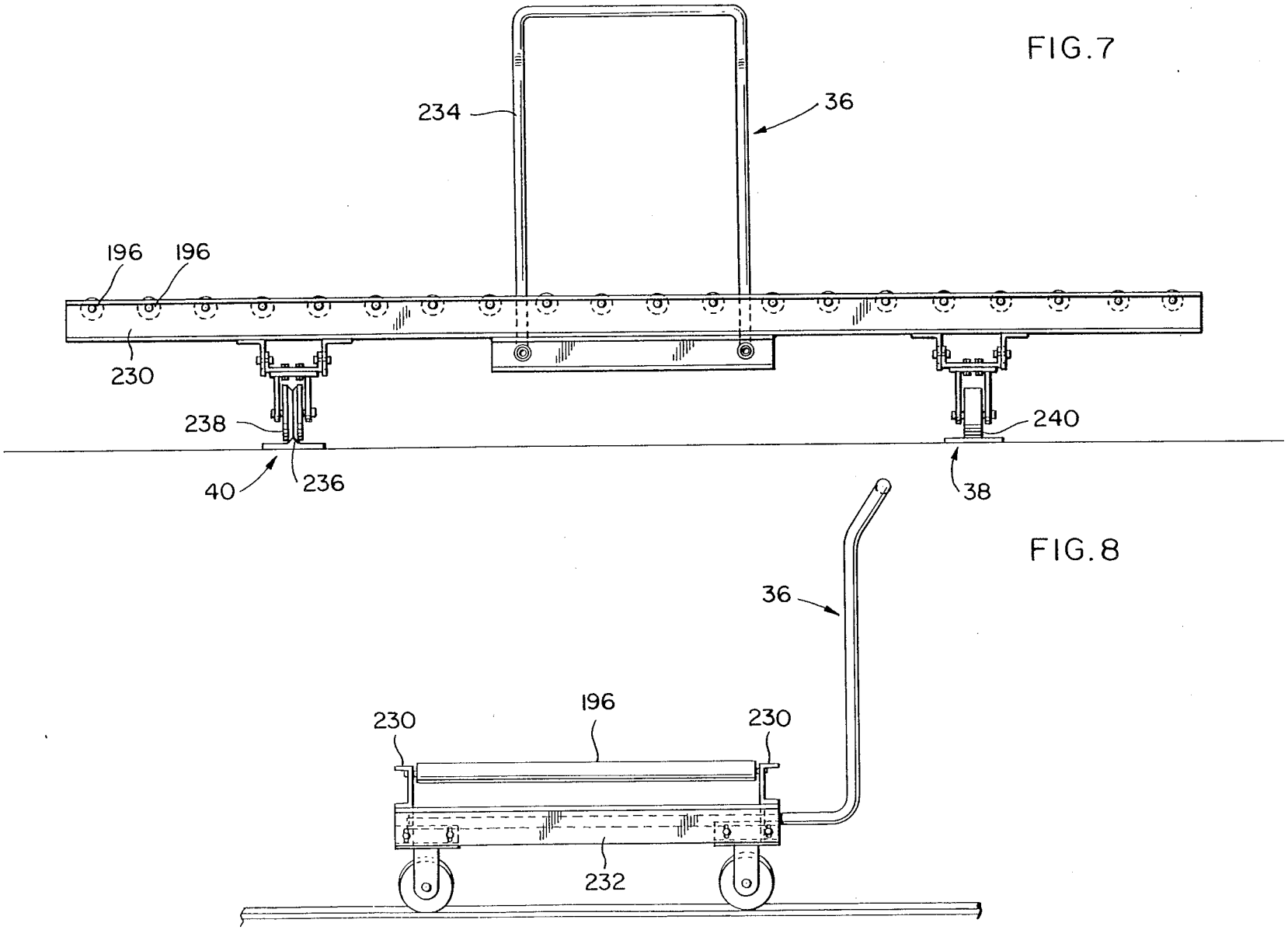
FIG. 7 is an elevational view of a transfer car and conveyor on tracks.
FIG. 8 is a side view of a transfer car on tracks.
Figure 9A:
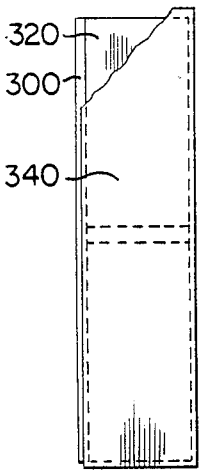
FIGS. 9A, 9C, 9D, and 9F through 9J are examples of structural wall panels.
Figure 9B:
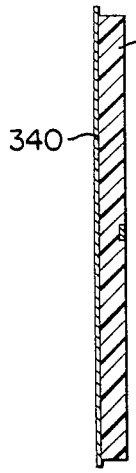
FIG. 9B is a side view of FIG. 9A.
Figure 9C:
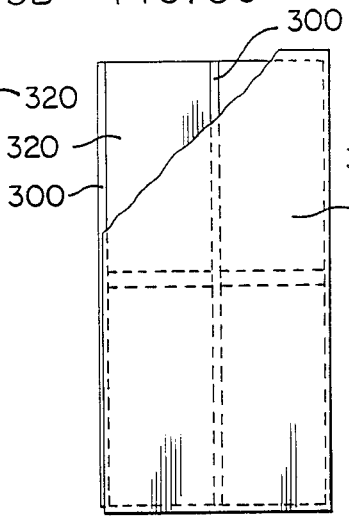
Figure 9D:
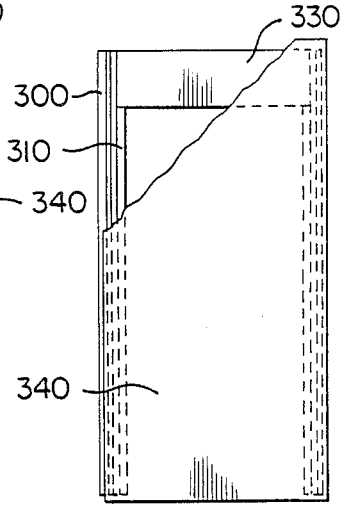
Figure 9E:
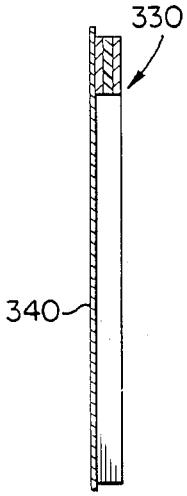
FIG. 9E is a side view of FIG. 9D.
Figure 9F:
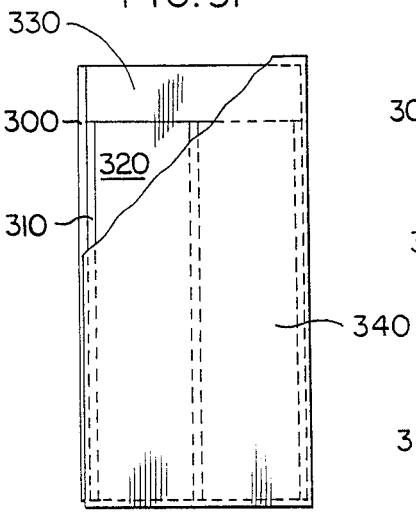
Figure 9G:
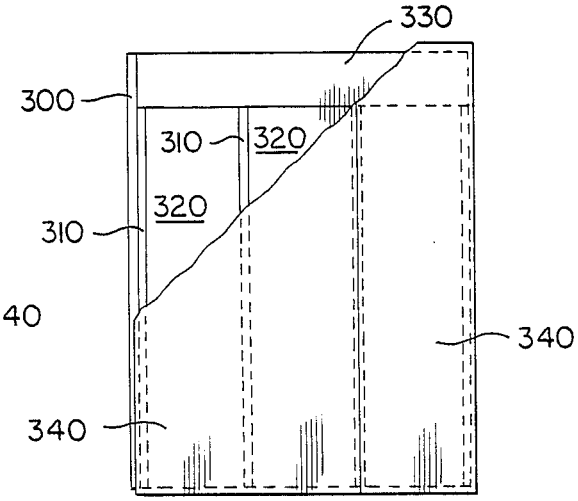
Figure 9H:
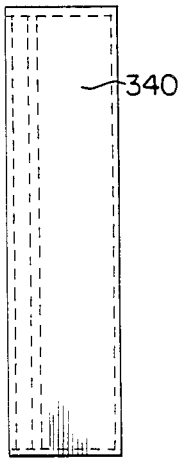
Figure 9I:
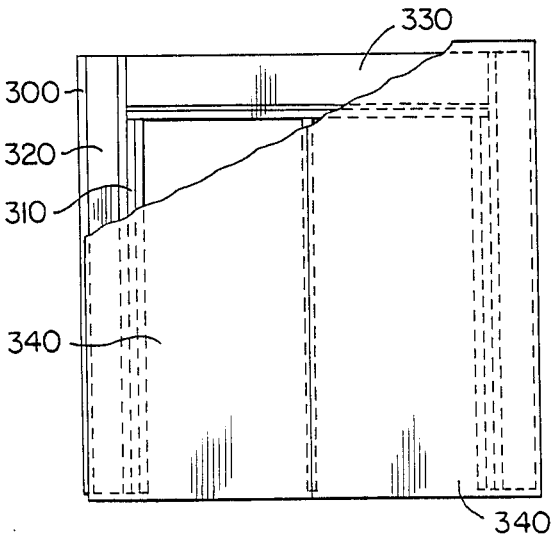
Figure 9J:
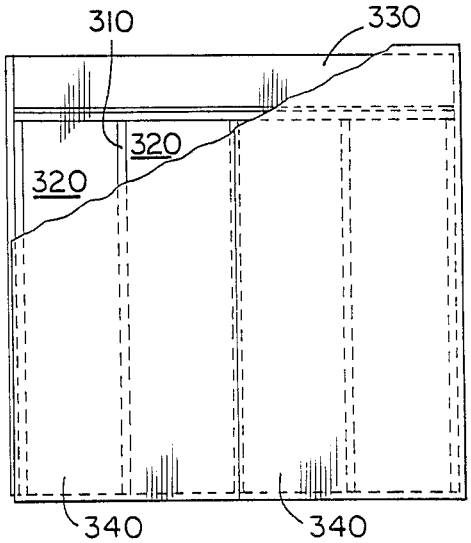

Transfer car 36 is shown in FIGS. 7 and 8. Spanning between two side rails 230 extend rollers 196. Mounted on a base 232 is U-shaped handle 234, which is used to roll the transfer car along tracks 38 and 40 laid on the floor.

As shown in FIG. 7, vertical track 40 includes an angled projction 236, which fits in a similarly shaped recess defined in wheel 238. Flat track 38 is used to guide cylindrical wheels 240. Engagement of the projection 236 in wheel 238 is sufficient to maintain the direction of travel of the transfer car between press 42 and press 44. The transfer car is manually stopped at either press 42 or 44, and the stack of panels on the transfer car are manually moved to the selected press. The transfer car is then manually moved to a position adjacent to the lay-up table to receive another stack of panels for pressing.

Having described the invention, many modifications thereto will become apparent to those skilled in the art to which it pertains without deviating from the spirit of the invention, as defined in the scope of the appended claims.

I claim:

1. A system for manufacturing prefabricated wall sections having a panel and a plurality of wall section components, said system comprising:

loading means for holding a stack of panels, feed means for repetitively feeding successive top panels from said stack of panels in a predetermined direction, adhesive means for applying adhesive to each successive top panel as said top panel is being fed, a lay-up table for assemblying wall sections, first guide means for aligning and compressing said plurality of wall section components in a predetermined position after being loosely placed on said table, second guide means for locating said side edges of said panel offset from peripheral side edges of said plurality of wall section components in said predetermined position so that said peripheral side edges of said plurality of wall section components are recessed from said side edges of said panel on three sides of said panel and one of said side edges of said plurality of wall section components projects beyond one of said peripheral side edges of said panel, and press means for pressing said panel with adhesive onto said wall section components for a time sufficient to secure said panel to said components.

2. A system for manufacturing prefabricated wall sections as in claim 1, wherein said first guide means include guide plates movable towards and away from said table upon which said plurality of wall section components are assembled.

3. A system for manufacturing prefabricated wall sections as in claim 2, wherein said first guide means are located on two parallel sides of said table.

4. A system for manufacturing prefabricated wall sections as in claim 2, wherein said first guide means are located on two sides of said table.

5. A system for manufacturing prefabricated wall sections as in claim 2, wherein said table is vertically movable for assembling each of a plurality of prefabricated wall sections on said table at a constant height.

6. A system for manufacturing prefabricated wall sections as in claim 1, wherein said loading means is vertically movable to maintain each top panel at a constant feed height.

7. A system for manufacturing prefabricated wall sections, said system comprising:

a feed table for holding a stack of panels, feed means for engaging and moving a top panel from said stack in a predetermined direction, adhesive means for applying adhesive to said top panel as said top panel is fed by said feed means, a lay-up table, a fixed guide positioned adjacent said lay-up table for aligning a plurality of wall section components on said lay-up table, movable guides positioned adjacent said lay-up table and being movable towards and away from said lay-up table for positioning said plurality of wall section components in a predetermined position and for aligning said top panel in combination with said fixed guide offset from side edges of said plurality of wall section components in said predetermined position so that said side edges of said plurality of wall section components are recessed from said side edges of said panel on three sides of said panel and one of said side edges of said plurality of wall section components projects beyond one of said side edges of said panel, and press means for pressing said top panel with adhesive onto said plurality of wall section components as aligned by said movable guides.

8. A system for manufacturing prefabricated wall sections as in claim 7, further comprising means for raising said feed table to a constant feed height after said top panel is removed from said stack so as to position another panel in said stack at the same height as was previously occupied by said top panel.

9. A system for manufacturing prefabricated wall sections as in claim 7, further comprising means for lowering said lay-up table to a position aligned with said feed table for receipt of said top panel.

10. A method of manufacturing prefabricated wall sections having a panel and a plurality of wall section components, said method comprising:

loading a plurality of panels in a stack, repetitively feeding a top panel from said stack in a predetermined direction, applying adhesive to said top panel as said top panel is being fed, loosely assembling said plurality of wall section components, compressing said plurality of wall section components together, locating side edges of said top panel offset from peripheral side edges of said assembled and said compressed together plurality of wall section components so that said peripheral side edges of said plurality of wall section components are recessed from said side edges of said panel on three sides of said panel and one of said peripheral side edges of said plurality of wall section components projects beyond one of said side edges of said panel, and pressing said panel with adhesive onto said wall section components for a time sufficient to secure said panel to said wall section components.

11. A system for manufacturing prefabricated wall sections as in claim 1, wherein said first guide means includes a fixed position guide located at one side edge of said lay-up table and a movable guide plate located adjacent to and extending perpendicular to said fixed position guide.

12. A system for manufacturing prefabricated wall sections as in claim 11, wherein said movable guide plate includes spacing means for positioning said plurality of wall section components recessed from one of said side edges of said panel.

13. A system for manufacturing prefaricated wall sections as in claim 12, wherein said second guide means is located above said first guide means to position said side edges of said panel projecting beyond three of said side edges of said plurality of wall components.

14. A system for manufacturing prefabricated wall sections as in claim 7, wherein a portion of said fixed guide and a portion of said movable guide locates said side edges of said panel above and projecting beyond said peripheral side edges of said plurality of wall section components.

15. A system for manufacturing prefabricated wall sections as in claim 7, wherein at least one of said movable guides includes a spacer for recessing a peripheral side edge of said plurality of wall section components from said side edges of said panel in said predetermined position.

16. A system for manufacturing prefabricated wall sections as in claim 7, wherein a spacing means is located in contact with said fixed guide to position a peripheral side edge of said plurality of wall section components recessed from said side edges of said panel when said plurality of wall section components are in said predetermined position and said panel contacts said fixed guide.

17. A method for manufacturing prefabricated wall sections as in claim 10, wherein a set of wall section components are loosely placed on top of a previously fed top panel and compressed together after lowering of a previously assembled wall section to a wall section assembly height.

18. A method for manufacturing prefabricated wall sections as in claim 10, wherein all of the previous steps except the first step and the last step are repeated until a predetermined number of wall sections are assembled, after which said pressing step is performed.

19. A method for manufacturing prefabricated wall sections as in claim 10, wherein only one panel is fed to each set of wall section components to form a wall section.

* * * * *